US010857800B2

(12) United States Patent
Tarrida Tirado et al.

(10) Patent No.: US 10,857,800 B2
(45) Date of Patent: Dec. 8, 2020

(54) LIQUID DISPENSERS

(71) Applicant: HEWLETT-PACKARD DEVELOPMENT COMPANY, L.P., Spring, TX (US)

(72) Inventors: Francesc Tarrida Tirado, Sant Cugat del Valles (ES); Sara Molins Cabani, Sant Cugat del Valles (ES); Xavier Gasso Puchal, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/494,056

(22) PCT Filed: Jun. 13, 2017

(86) PCT No.: PCT/US2017/037210
§ 371 (c)(1),
(2) Date: Sep. 13, 2019

(87) PCT Pub. No.: WO2018/231203
PCT Pub. Date: Dec. 20, 2018

(65) Prior Publication Data

US 2020/0070522 A1 Mar. 5, 2020

(51) Int. Cl.

| | |
|---|---|
| ***B41J 2/165*** | (2006.01) |
| ***B08B 1/00*** | (2006.01) |
| ***B08B 1/02*** | (2006.01) |
| ***B08B 3/02*** | (2006.01) |

(52) U.S. Cl.
CPC ..... *B41J 2/16544* (2013.01); *B08B 1/006* (2013.01); *B08B 1/02* (2013.01); *B08B 3/022* (2013.01); *B41J 2/16538* (2013.01); *B41J 2/16552* (2013.01); *B41J 2002/1655* (2013.01); *B41J 2002/16558* (2013.01); *B41P 2235/20* (2013.01)

(58) Field of Classification Search
CPC ..... B41J 2/16544; B41J 2/16538; B41J 2/16552; B41J 2002/1655; B41J 2002/16558; B41J 2/16535; B08B 1/006; B08B 1/02; B08B 3/022; B08B 1/005; B41P 2235/20
See application file for complete search history.

(56) References Cited

U.S. PATENT DOCUMENTS

| | | | | |
|---|---|---|---|---|
| 5,115,250 A | | 5/1992 | Harmon et al. | |
| 5,644,346 A | * | 7/1997 | Schwiebert | B41J 2/16547 347/33 |
| 5,644,347 A | * | 7/1997 | Schwiebert | B41J 2/16511 347/24 |

(Continued)

FOREIGN PATENT DOCUMENTS

| | | |
|---|---|---|
| CN | 2820541 | 9/2006 |
| CN | 101272916 | 9/2008 |

(Continued)

*Primary Examiner* — Huan H Tran
(74) *Attorney, Agent, or Firm* — Trop, Pruner & Hu, P.C.

(57) ABSTRACT

In an example, a wiper system includes a first wiper blade, a second wiper blade, and a liquid dispenser. In that example, the liquid dispenser is oriented to eject liquid towards a cloth area across from the first wiper blade when the first wiper blade is in a rest position and the second wiper blade is in a service position.

15 Claims, 14 Drawing Sheets

(56) References Cited

U.S. PATENT DOCUMENTS

| | | | | |
|---|---|---|---|---|
| 5,806,994 | A | 9/1998 | Coffy et al. | |
| 5,847,727 | A * | 12/1998 | VanLiew | B41J 2/16547 347/33 |
| 5,907,335 | A | 5/1999 | Johnson et al. | |
| 6,102,518 | A * | 8/2000 | Taylor | B41J 2/16552 347/28 |
| 6,530,642 | B1 | 3/2003 | Uchitata et al. | |
| 6,655,781 | B2 | 12/2003 | Nakagawa et al. | |
| 6,679,579 | B1 | 1/2004 | Tee et al. | |
| 6,764,161 | B1 | 7/2004 | Nakagawa et al. | |
| 7,159,962 | B2 | 1/2007 | Wouters | |
| 7,740,335 | B2 * | 6/2010 | Miyamoto | B41J 2/16538 347/33 |
| 7,993,466 | B2 | 8/2011 | Aude | |
| 8,733,889 | B2 | 5/2014 | Uemura | |
| 2007/0188545 | A1 * | 8/2007 | Miyamoto | B41J 2/16585 347/33 |
| 2008/0316252 | A1 | 12/2008 | Na et al. | |
| 2011/0292126 | A1 | 12/2011 | Nystrom et al. | |
| 2011/0310171 | A1 | 12/2011 | Supron et al. | |
| 2013/0002756 | A1 | 1/2013 | Kriz | |
| 2013/0257979 | A1 | 10/2013 | Adachi | |
| 2017/0015101 | A1 | 1/2017 | Coma Vives et al. | |
| 2017/0066244 | A1 | 3/2017 | Fujioka et al. | |
| 2020/0055316 | A1 * | 2/2020 | Tarrida Tirado | B08B 1/005 |

FOREIGN PATENT DOCUMENTS

| | | | |
|---|---|---|---|
| CN | 102259494 | | 11/2011 |
| CN | 102649362 | | 8/2012 |
| CN | 104626752 | | 5/2015 |
| CN | 106029386 | | 10/2016 |
| EP | 0913262 | A1 | 5/1999 |
| EP | 1310367 | A1 | 5/2003 |
| JP | 04232754 | | 8/1992 |
| JP | 2008137266 | | 6/2008 |
| JP | 2011148173 | | 8/2011 |
| JP | 2012171345 | | 9/2012 |
| JP | 2013116639 | | 6/2013 |
| JP | 2013226813 | | 11/2013 |
| JP | 2014162135 | | 9/2014 |
| JP | 2017052117 | | 3/2017 |
| JP | 2020511330 | | 4/2020 |
| WO | WO-1998045122 | A1 | 10/1998 |

* cited by examiner

LIQUID DISPENSERS

BACKGROUND

Images are processed for use with computing machines, such as a print apparatus. A print apparatus, for example, may use control data based on processed image data to reproduce a physical representation of an image by operating a print fluid ejection system according to the control data. Components of a print apparatus, such as a fluid ejection device, may be serviced to improve print quality and/or the life of the component, for example. Some print apparatus include a mechanism, such as a service station, to perform various service routines.

DETAILED DESCRIPTION

Figure 1:
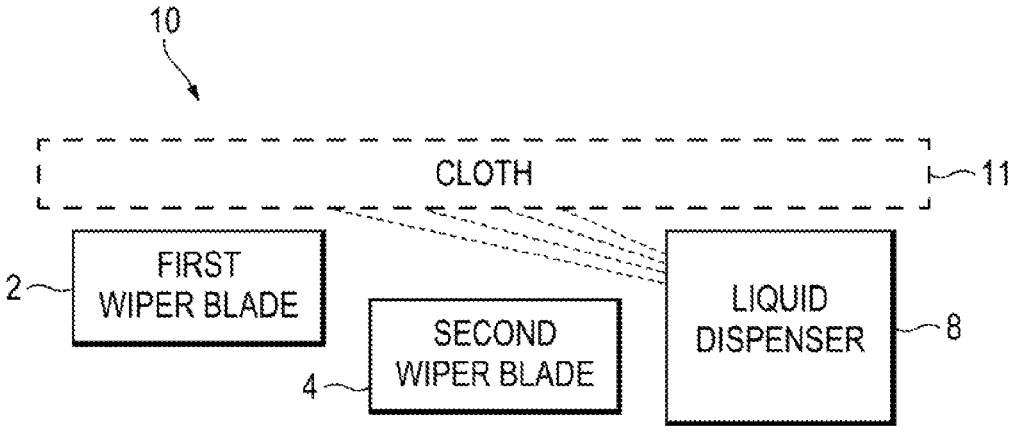
FIG. 1 is a block diagram depicting an example wiper system.

In the following description and figures, some example implementations of print apparatus, service station systems, and/or methods of operating blades of a wiper system. In examples described herein, a "print apparatus" may be a device to print content on a physical medium (e.g., paper, textile, a layer of powder-based build material, etc.) with a print material (e.g., ink or toner). For example, the print apparatus may be a wide-format print apparatus that prints latex-based print fluid on a print medium, such as a print medium that is size A2 or larger. The physical medium may printed on from sheets or a web roll. In the case of printing on a layer of powder-based build material, the print apparatus may utilize the deposition of print materials in a layer-wise additive manufacturing process. A print apparatus may utilize suitable print consumables, such as ink, toner, fluids or powders, or other raw materials for printing. In some examples, a print apparatus may be a three-dimensional (3D) print apparatus. An example of fluid print material is a water-based latex ink ejectable from a print head, such as a piezoelectric print head or a thermal inkjet print head. Other examples of print fluid may include dye-based color inks, pigment-based inks, solvents, gloss enhancers, fixer agents, and the like.

A print apparatus may include a service station to perform service routines on a component of the print apparatus. For example, a service station may include a wiping system and/or scraping system to remove excess print fluid from the fluid ejection device of the print apparatus. A service station may include a web material to use for wiping the fluid ejection device. The web material may be a consumable that moves used web material out of the way and moves unused web material to use for the subsequent service routine. The web material may be a textile, such as cloth, or made of other material appropriate for wiping a component of the print apparatus. Example textile web material of the service station may be woven fabric, non-woven fabric, fabric with synthetic layers, and the like. The cloth may be impregnated with a cleaning liquid or substantially dry (e.g., without liquid impregnated into the cloth).

The surface of a print head may have different types of serviceable issues. For example, excess print fluid may be wiped from the nozzle plate easier than solidified print substance (e.g., crusting). Various examples described below relate to providing different wiping operations that focus on performing characteristically different issues. A plurality of wipers are implemented on the service station to provide different amounts of force and/or other wiping characteristics. In this manner, the amount of force on the cloth may be adjusted to take care of different types of vice issues using a wiper system, for example.

The terms "include," "have," and variations thereof, as used herein, mean the same as the term "comprise" or appropriate variation thereof. Furthermore, the term "based on," as used herein, means "based at least in part on." Thus, a feature that is described as based on some stimulus may be based only on the stimulus or a combination of stimuli including the stimulus.

FIG. 1 is a block diagram depicting an example wiper system 10. The wiper system 10 generally includes a first wiper blade 2, a second wiper blade 4, and a liquid dispenser 8. The first wiper blade 2 and the second wiper blade 4 may be raiseable to different heights for performing a service operation on a print head. For example, the first wipe position corresponding to the service position of a first wiper blade and the second wipe position corresponding to the service position of a second wiper blade are different interference heights (with reference to a print head carriage holding a print head to be wiped and/or with reference to a rest position of the cloth) that apply different force amounts on the cloth covering the first wiper blade and the second wiper blade (e.g., perpendicular force on the cloth with respect to the media advance to divert the cloth advance path). For example, the second wiper blade may be in a position higher than the first wiper blade during a service operation. In this manner, each wiper blade may divert the cloth towards a position of the print head carriage to a different amount based on the calibrated height of each wiper blade. The first and second wiper blades may be oriented parallel to each other at a wiping area.

The first wiper blade and the second wiper blade may be made of different materials with different compression attributes. For example, the first wiper blade 2 may be made of a silicone rubber composite and the second wiper blade 4 may be made of a plastic. The first wiper blade and the second wiper blade may a combination of shape, thickness, and material that produces linear deformation. For example, the blade may have a diamond shape with walls of a certain thickness of flexible material to allow for distributed compression along the length of the blade. Example compression amounts may be 2.5 mm when applying 12 newtons or 4 mm when applying 20 newtons, for example. The blade may be extruded with reference to the length of the blade to assist in substantial linear deformation upon receiving a compression force on the blade. The length of the blade may span substantially across the width of the cloth and may be substantially the same length of the cloth width.

The liquid dispenser 8 provides liquid for servicing operations performed by the wiping system. Example cleaning liquids may include distilled water, polyethylene glycol, a combination thereof, and the like. The liquid dispenser 8 may include components that induce liquid to be deposited on to cloth 11. The liquid dispenser 8 may selectively deposit liquid onto the cloth at the areas used by the wiper blades 2 and 4. Liquid may be deposited by the liquid dispenser 8 on the cloth 11 whether or not it is impregnated with a cleaning fluid. For example, the additional fluid may improve the wiping experience of a cloth that already has cleaning fluid on and/or in the cloth. In an example, the liquid dispenser is oriented to eject liquid towards an area of the cloth corresponding to a wiper blade and may also be oriented to not eject liquid towards an area of cloth corresponding to another wiper blade. The liquid may be ejected from the liquid dispenser 8 based on forces applicable by the blades and/or blade positioning. For example, the liquid dispenser may be oriented to eject liquid towards a cloth area across from the second wiper blade 4 when the second wiper blade 4 is in a rest position and the first wiper blade 2 is in a service position. For another example, the liquid dispenser may be oriented to eject liquid over a wiper blade calibrated to place the most force on the cloth 11 (e.g., when that blade is in a rest position). The orientation of the liquid dispenser 8 may also assist proper placement of liquid, such as inducing distribution of the liquid across the width of the cloth. For example, the liquid dispenser 8 may be mounted to a frame 120 in a fixed position oriented to emit a spray pattern that extends across a length of the first wiper blade. The length of the wiper blade may be parallel to the width of the cloth of the service station.

The positions of the blades may assist or hinder placement of the liquid ejected from the liquid dispenser 8 onto the cloth 11. For example, when the first wiper blade 2 is in a service position, it may hinder spray from getting on the cloth across from the first wiper blade. In another example, when the second wiper blade 4 is in a service position, it may hinder spray from getting on the cloth across from the second wiper blade. Though the position of a blade may hinder the liquid dispenser 8 from ejecting liquid towards a cloth area, extending a wiper blade to a service position may assist placement of the liquid on the cloth 11 by raising the cloth away from the liquid dispenser 8, for example.

Figure 2:
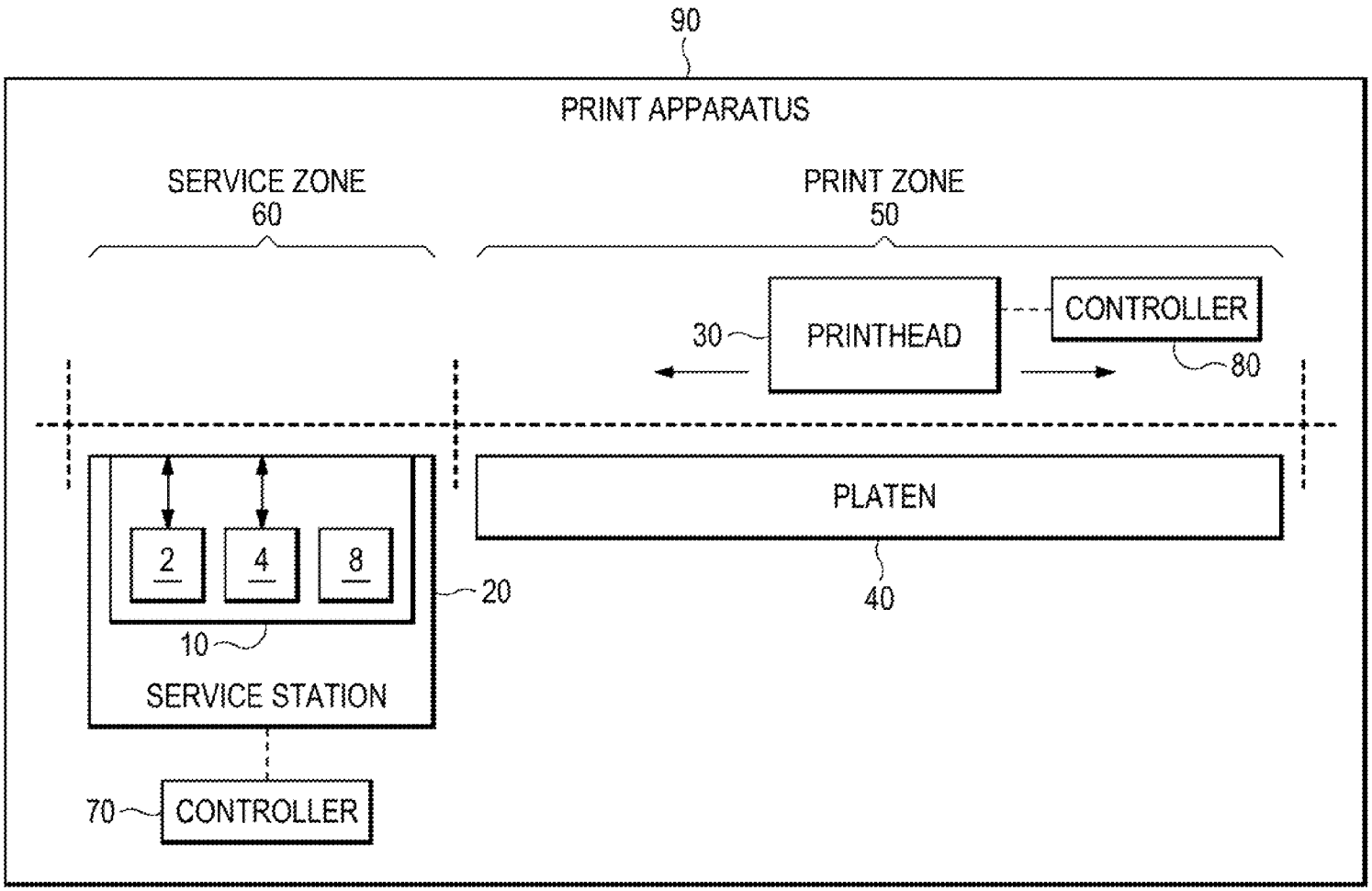
FIG. 2 is a block diagram of an example print apparatus.

FIG. 2 is a block diagram of an example print apparatus 90 having an example service station 20 with a wiper system 10 having multiple wiper blades 2 and 4 with adjustable heights. The blades 2 and 4 may be moved to different heights as operated by a controller 70. For example, the controller 70 coupled to the service station 20 may control rotation of a cam, using a motor and gear system, to an angle based on a print head scanning operation location (e.g., whether the print head carriage is inside or outside a print zone 50, the direction of movement of the print head carriage, etc.).

Another controller 80 may operate movement of a print head 30 used to eject print fluid on media passing along a platen 40. The print head scans or is otherwise moveable between a print zone 50 of the print apparatus and a service zone 60. The print zone 50 includes the area where media is printed on between the platen and lateral scanning positions of the print head 30 over the platen 30. The service zone 60 includes the area between the service station 20 and the lateral scanning positions of the print head 30 over the service station 20. As discussed further herein, in particular with reference to FIGS. 13-17, the height of the wiper blades may be synchronized with movement of the carriage holding the print head 30.

The controller 70 of the service station 20 may be coupled to control a liquid dispenser 8. The controller 70 may drive a motor to move a first wiper blade to rest position before ejection of liquid and then cause the liquid dispenser 8 to eject a spray pattern on the cloth before a print head is serviced by the cloth (e.g., before the print head carriage passes over the service zone 60). For example, the controller 70 may include instructions that when executed coordinate liquid ejection with position of the first wiper blade and cause the liquid dispenser to eject liquid when a cam coupled to the blades is rotated to an angle corresponding to the second cam position and a print head carriage of a print apparatus is in a print zone of the print apparatus as shown in FIGS. 3-7 and FIGS. 8-11.

Figure 3:
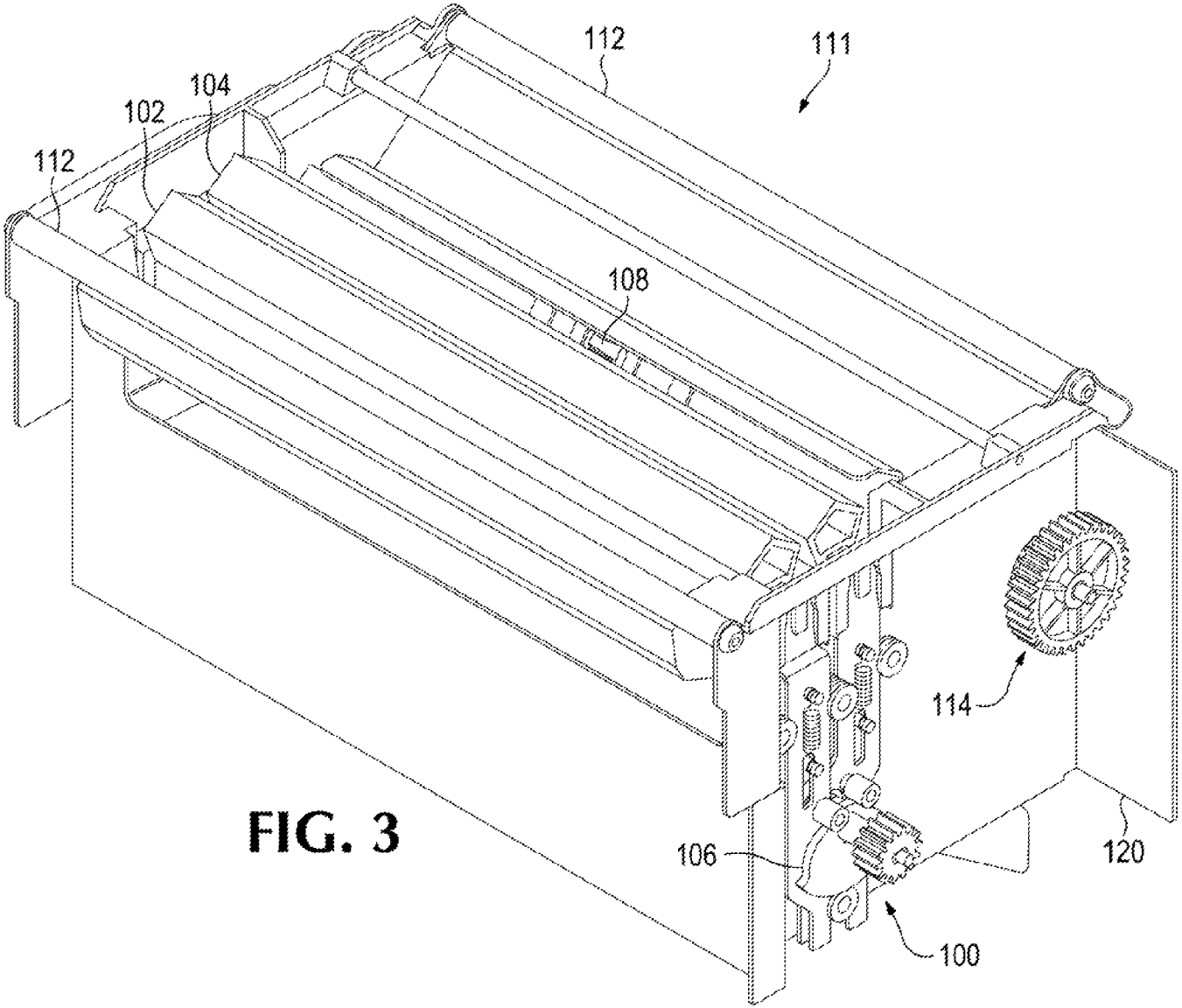
FIG. 3 depicts an example service station.

FIG. 3 depicts an example service station 101. The example service station 101 generally includes a wiper system 100 and a cloth advance mechanism 114. The wiper system 100 includes a first wiper blade 102, a second wiper blade 104, and a cam 106. The cloth advance mechanism 114 is able to advance cleaning cloth along a path defined by bars 112 using media handling components such as driven wheels, gears, pinch wheels, etc. The cloth advance mechanism 112 is able to advance the cloth over the first wiper blade 102 and second wiper blade 104 (e.g., a cloth wiping area) where the blades can press against the cloth to position the cloth to clean a print head with a particular amount of force.

FIGS. 4-7 are isometric views depicting example states of an example wiper system 100. The wiper system 100 generally includes a first wiper blade 102 and a second wiper blade 104 that are adjustable in position based on orientation of the cam 106. The cam 106 may be rigidly coupled to a shaft 118 having a corresponding cam 116 at a distal end of the shaft 118 (where the corresponding cam 116 is distal with reference to the location of the cam 106 with respect to the shaft 118). The cams 106 and 116 are rotatable to angles that correspond to different cam positions, such as a first cam position corresponding to placing a first wiper blade in a service position (e.g., a lifted position), a second cam position corresponding to placing a second wiper blade in a service position (e.g., a lifted position), and a third cam position where both the first wiper blade and the second wiper blade 104 are in a rest position (e.g., a down position).

Figure 4:
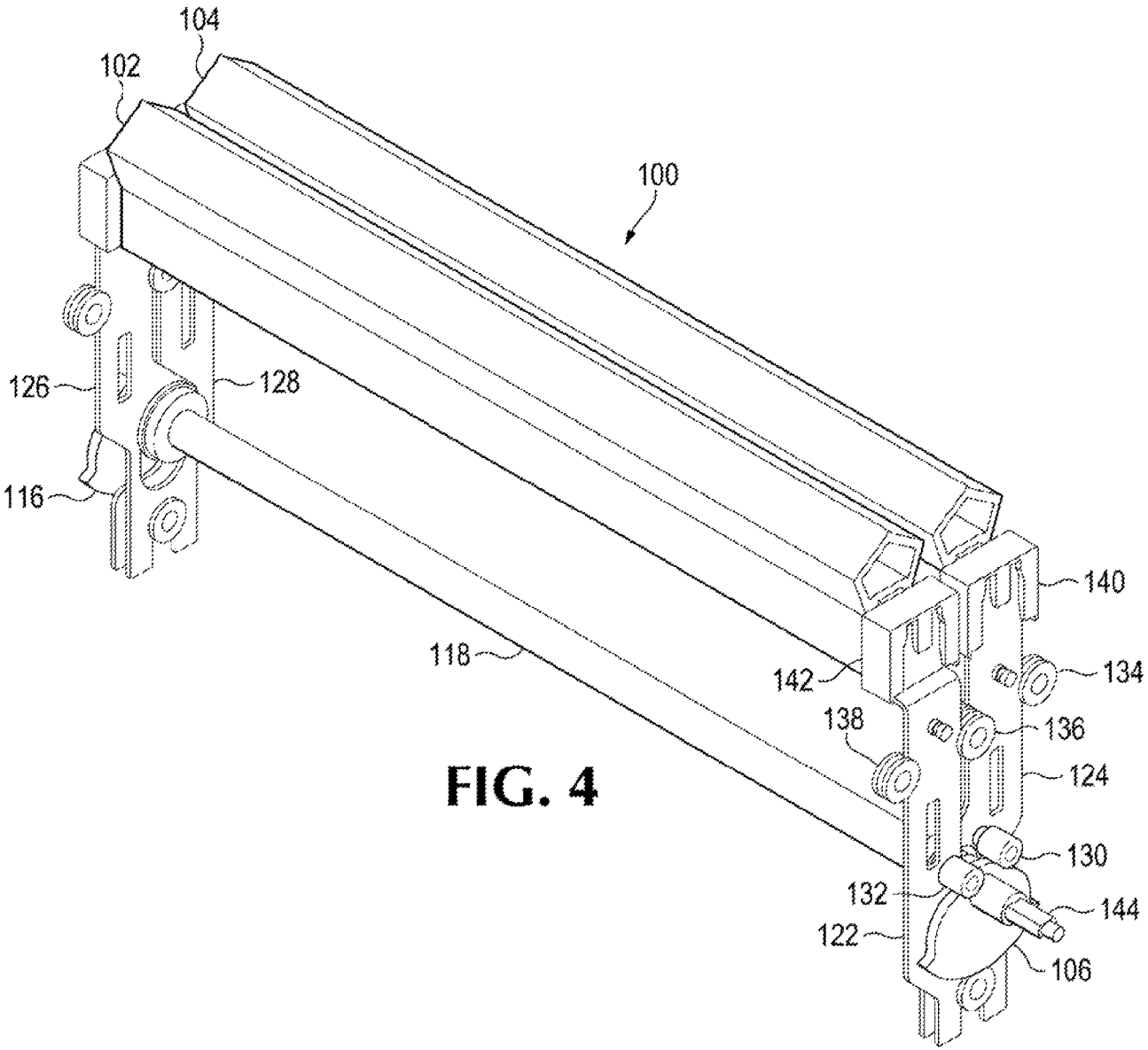
FIGS. 4-7 are isometric views depicting example states of an example wiper system.
Figure 5:
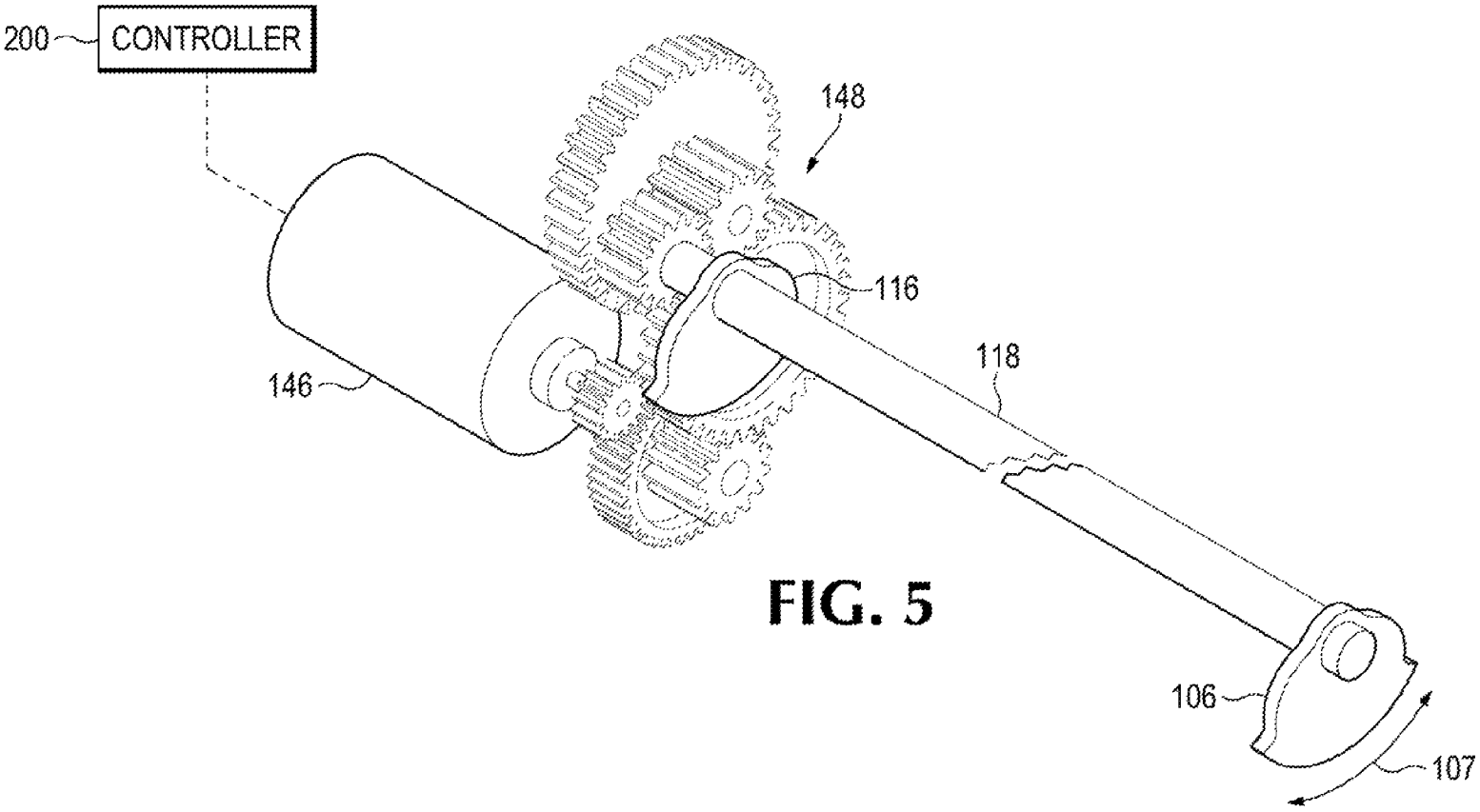

In the example of FIGS. 4-7, the cams 106 and 116 are coupled by a shaft 118 so that the cams 106 and 116 rotate at the same time. The shaft 118 may be rotatable via a connector end 141 that may be connectable to an adjustable transmission force, such as a motor. For example, FIG. 5 depicts the shaft 118 coupled to a motor 146 via a gear system 148 such that the cams 106 and 116 that are fixedly coupled to the shaft 118 rotate together as the shaft 118 rotates. In that example, the motor 146 may be encoded to rotate the cams 106 and 116 to angles corresponding to the first cam position that lifts the first wiper blade and the second cam position that lifts the second wiper blade. Also with reference to FIG. 5, the motor 146 may be operated based on instructions executed by a controller 200. For example, a controller coupled to the motor may control rotation of the cam to an angle based on power output of the motor. The controller 200 is discussed further with reference to FIG. 12.

The cams 106 and 116 are shaped to generate movement of the blades 102 and 104 via the plates 122, 124, 126, and 128. In the example of FIG. 5, the shape of cam 106 includes recesses to catch pegs, such as peg 130 of FIG. 6 and peg 132 of FIG. 7. Other examples may include other cam shapes that induce wiper blade positioning, for example the cam may have edges shaped with different distances from a center of rotation of the cam to induce a movement corresponding to the distances as the cam rotates.

Figure 6:
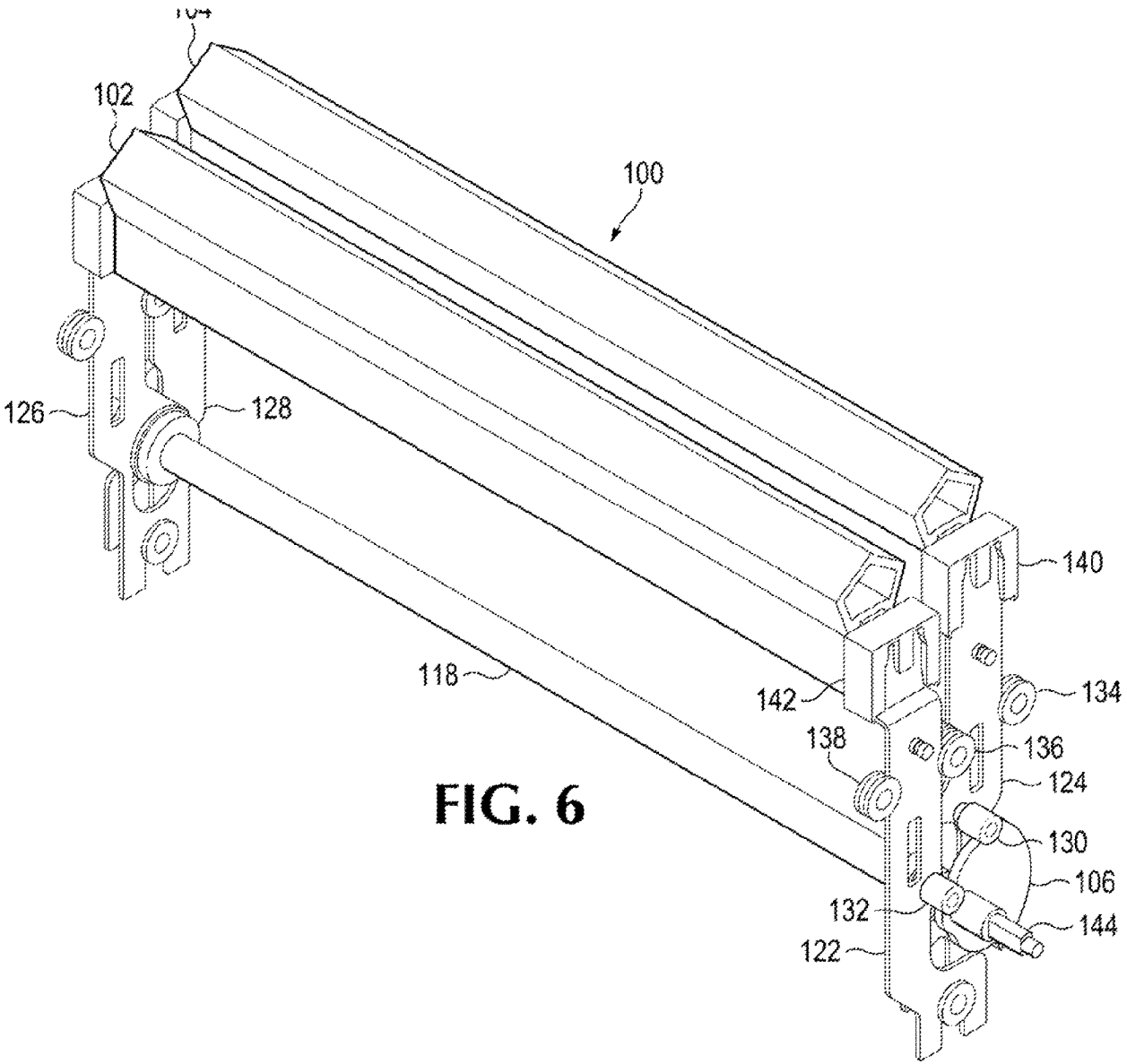
Figure 7:
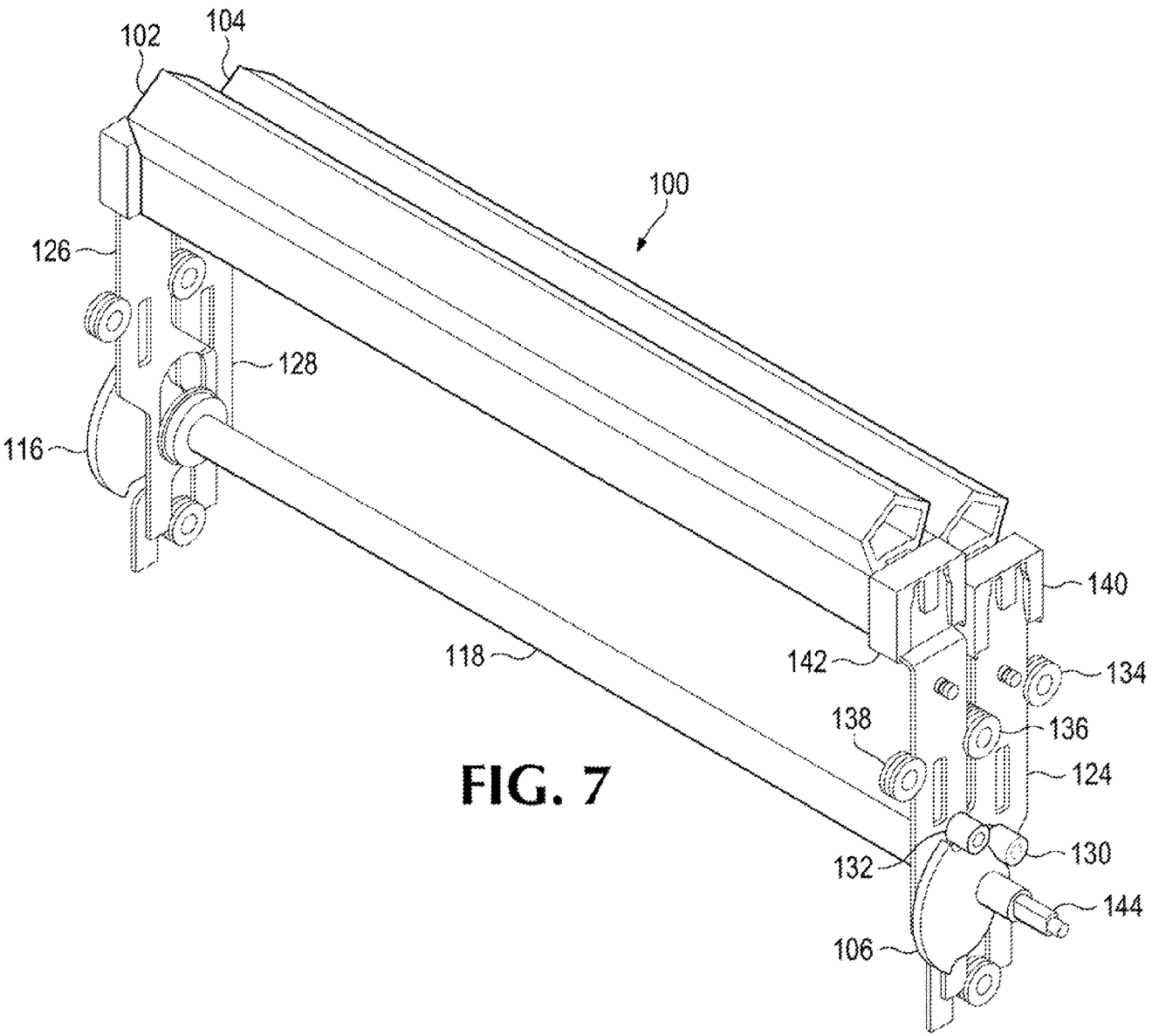

As the cams 106 and 116 rotate (as shown by directional arrow 107), plates 122, 124, 126, and 128 may shift the positions of the wiper blades 102 and 104. For example, a first set of plates coupled to the first wiper blade move the first wiper blade to the first wiper position when the cam is rotated to an angle corresponding to the first cam position and a second set of plates move the second wiper blade to the second wiper position when the cam is rotated to an angle corresponding to the second cam position. The amount of lift of a blade may have a linear relationship with an angle of the cam 106. Examples of cam positions are shown in FIGS. 4, 6, and 7. Referring to FIG. 4, the first wiper blade 102 and the second wiper blade 104 are in a rest position where both blades 102 and 104 are not extended (e.g., do not place force on cloth of the service station). Referring to FIGS. 6 and 7, the cams 106 and 116 are rotatable into positions (e.g., to an angle) to lift a blade 102 or the other blade 104 to a selected height.

Referring to FIG. 6, the cam 106 is rotated to a cam position that moves a peg 130 coupled to the plate 124. The plate 124 moves as the peg 130 is moved based on contact with the cam 106 during rotation and guides 134 and 136. The wiper blade 104 is coupled to the plate 124 by a connector 140 such that as the plate 124 moves away from the cam 106, the wiper blade 104 moves in the same direction. In the example of FIG. 6, the blade 104 is in a service position (e.g., extended to place a diverting force on cloth of the service station) while blade 102 is in a rest position (e.g., not extended).

Referring to FIG. 7, the cam 106 is rotated to a cam position that moves a peg 132 coupled to the plate 122. The plate 122 moves as the peg 132 is moved based on contact with the cam 106 during rotation and guides 136 and 138. The wiper blade 102 is coupled to the plate 122 by a connector 142 such that as the plate 122 moves away from the cam 106, the wiper blade 102 moves in the same direction. In the example of FIG. 7, blade 102 is in a service position (e.g., extended to place a diverting force on cloth of the service station) while blade 104 is in a rest position (e.g., not extended).

Figure 8:
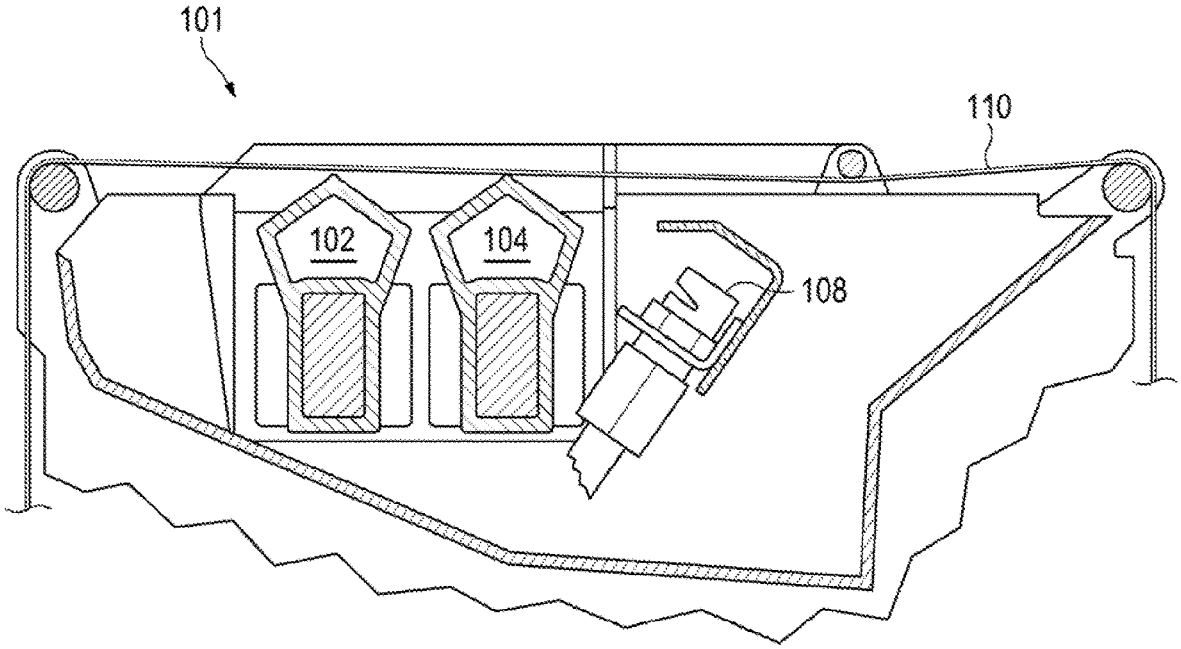
FIGS. 8-11 are side views depicting example states of an example wipe system.
Figure 9:
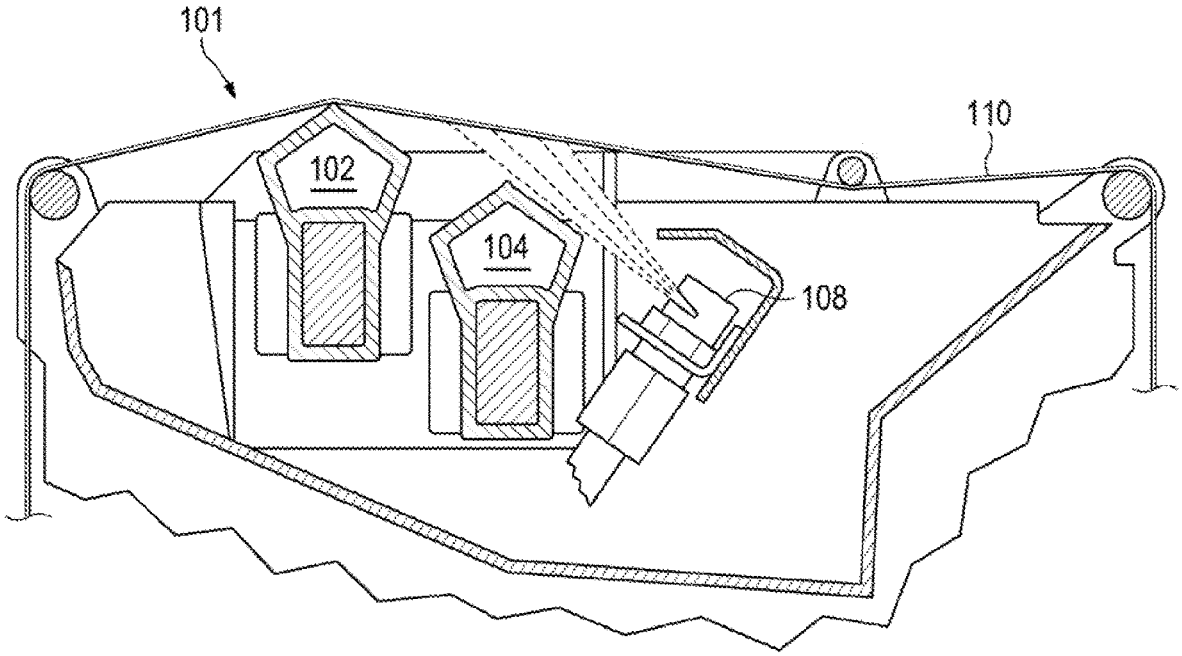

FIGS. 8-11 are side views depicting example states of an example service station 101. Referring to FIG. 8, wiper blades 102 and 104 are in rest positions where no additional force is placed on the cloth 110 by the wiper blades 102 and 104. Referring to FIG. 9, the wiper blade 102 is moved to an extended, service position that places force on the cloth 110 (e.g., a force perpendicular to the direction of cloth advance when the wiper blades are in the rest position of FIG. 8) and moves the cloth 110 away from the wiper blade 104. This allows for a first type of service operation to be performed, such as ejecting cleaning liquid onto the cloth from a liquid dispenser 108.

Figure 10:
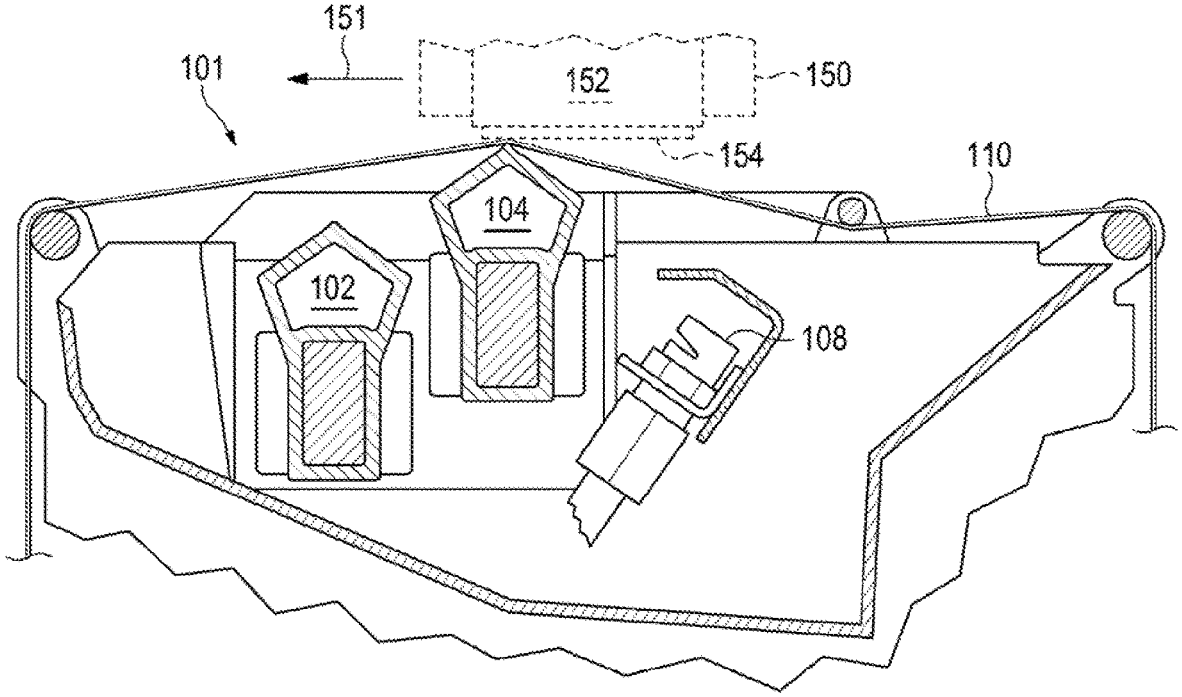

Referring to FIG. 10, the wiper blade 102 is moved back to a rest position and the wiper blade 104 is moved to an extended, service position that places force on the cloth 110 (e.g., a force perpendicular to the direction of cloth advance when the wiper blades are in the rest position of FIG. 8) and moves the cloth 110 away from the wiper blade 102. This allows for a second type of service operation to be performed where a print head carriage 150 moves in a first direction (represented by arrow 151). For example, the print head carriage 150 is controlled to move the print head 152 out of a print zone and into a service zone to allow a nozzle plate 154 to be cleaned by the cloth 100 by a first force based on the height of the wiper 104 with respect to the print head carriage 150. Note that in that example, the cloth area that was sprayed by the liquid dispenser 108 as shown in FIG. 9 may be used to make contact against the nozzle plate 154 (e.g., wipe a print head surface with a wet wipe service operation).

Figure 11:
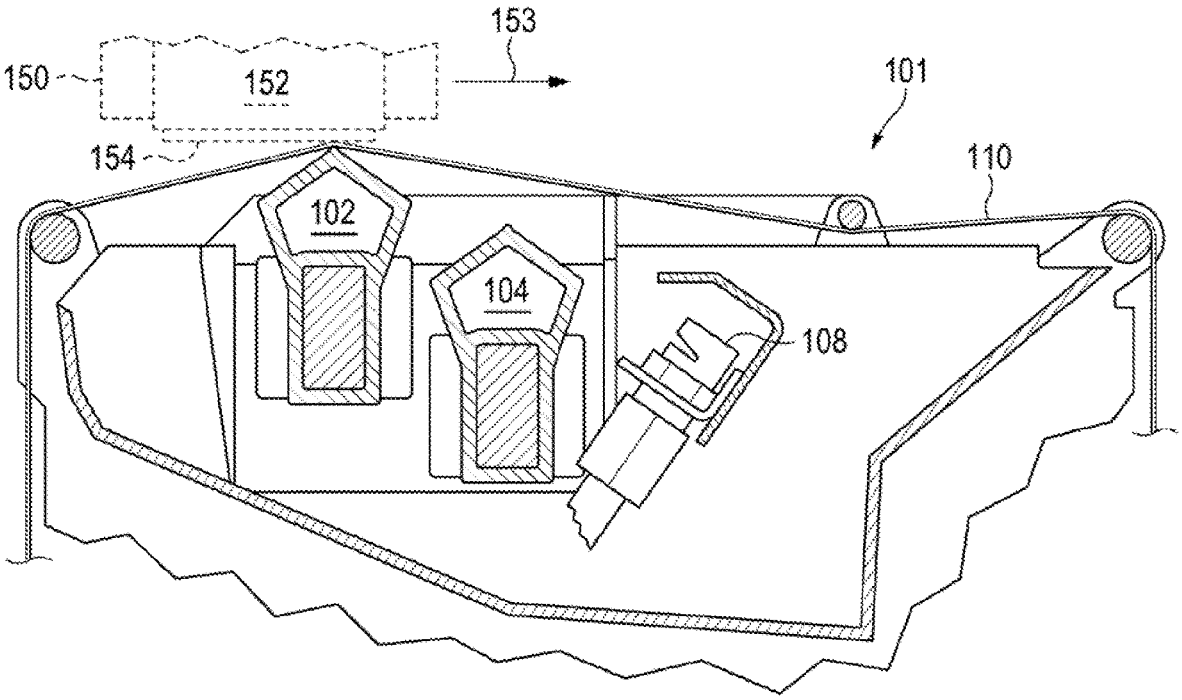

Referring to FIG. 11, the wiper blade 104 is moved back to a rest position and the wiper blade 102 is moved to an extended, service position that places force on the cloth 110 and moves the cloth 110 away from the wiper blade 104. This allows for a third type of service operation to be performed where a print head carriage 150 moves in a first direction (represented by arrow 153). For example, the print head carriage 150 is controlled to move the print head 152 from the service zone towards the print zone to allow a nozzle plate 154 to be cleaned by the cloth 110 by a second force based on the height of the wiper 102 with respect to the print head carriage 150. Note that in that example, a cloth area that was not sprayed by the liquid dispenser 108 may be used to place against the nozzle plate 154 (e.g., wipe a print head surface with a dry wipe service operation). In this manner, different combination of attributes of the service station components are used to provide different wiping operations on the service station which may allow for removal of different types of print fluid, for example, using a single service station to remove print fluid that is stuck of various degrees to the print head surface.

Figure 12:
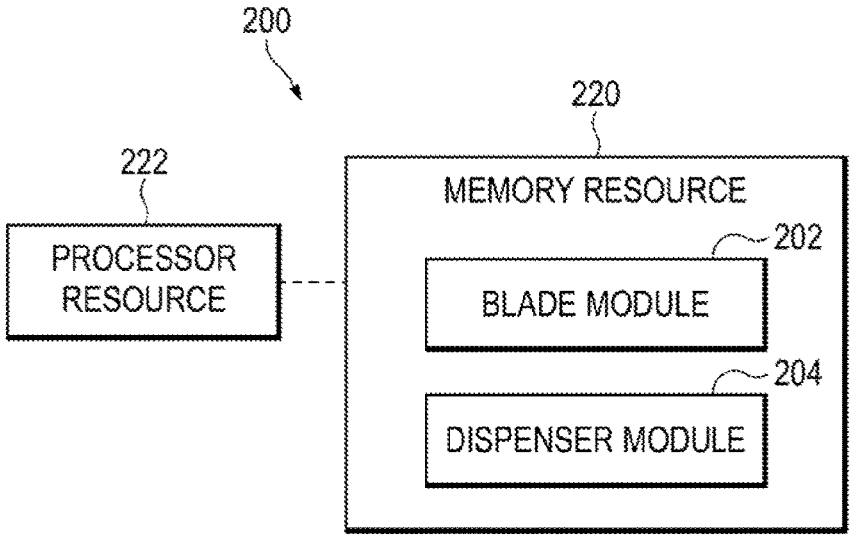
FIG. 12 is a block diagram depicting an example controller or a wiper system.

The positions of the blades in example states 8-11 and example service operations discussed herein may be operated by a controller. Referring to FIG. 12, a controller 200 for operating a service station may include a processor resources 222 and a memory resource 220. The memory resource 220 may contain a set of instructions that are executable by the processor resource 222. An example set of instructions include a blade module 202 and a dispenser module 204, where the blade module 202 represents program instructions that when executed cause control of the positions of blades of a wiper system and the dispenser module 204 represents program instructions that when executed cause control of the liquid dispenser (e.g., timing of spray, quantity of liquid, etc.). The set of instructions 202 and 204 are operable to cause the processor resource 222 to perform operations of the system 100 when the set of instructions are executed by the processor resource 222. The processor resource 222 may carry out a set of instructions to, for example, cause a motor to drive based on movement of a print head carriage of a print apparatus and operate a liquid dispenser of a service station to eject liquid based on a combination of location of the print head carriage and wiper positions of a plurality of wiper blades of the service station. For another example, the processor resource 222 may carry out a set of instructions to cause advancement of a cloth of the service station, cause a liquid dispenser to deposit liquid on the cloth before the print head carriage exits a print zone of a print apparatus. For yet another example, the processor resource 222 may carry out a set of instructions to cause a first wiper blade of the plurality of wiper blades closest to a liquid dispenser to move to a rest position, cause a second wiper blade of the plurality of wiper blades to move cloth of the service station away from the liquid dispenser, and cause the liquid dispenser to spray liquid onto the cloth across a length of the first wiper blade during a print operation. For yet another example, the processor resource 222 may carry out a set of instructions to calibrate a plurality of wiper blades to produce various forces on a cloth of a service station and cause a liquid dispenser to spray liquid on a cloth area position over a wiper blade of the plurality of wiper blades calibrated to produce the most force on the cloth.

A processor resource is any appropriate circuitry capable of processing (e.g., computing) instructions, such as one or multiple processing elements capable of retrieving instructions from a memory resource and executing those instructions. For example, the processor resource 222 may be a central processing unit (CPU) that enables positioning of blades of a wiper system by fetching, decoding, and executing the blade module 202 and the dispenser module 204. Example processor resources include at least one CPU, a semiconductor-based microprocessor, a programmable logic device (PLD), and the like. Example PLDs include an application specific integrated circuit (ASIC), a field-programmable gate array (FPGA), a programmable array logic (PAL), a complex programmable logic device (CPLD), and an erasable programmable logic device (EPLD). A processor resource may include multiple processing elements that are integrated in a single device or distributed across devices. A processor resource may process the instructions serially, concurrently, or in partial concurrence.

A memory resource represents a medium to store data utilized and/or produced by the system 200. The medium is any non-transitory medium or combination of non-transitory media able to electronically store data, such as modules of the system and/or data used by the system. For example, the medium may be a storage medium, which is distinct from a transitory transmission medium, such as a signal. The medium may be machine-readable, such as computer-readable. The medium may be an electronic, magnetic, optical, or other physical storage device that is capable of containing (i.e., storing) executable instructions. A memory resource may be said to store program instructions that when executed by a processor resource cause the processor resource to implement functionality of the wiper systems described herein. A memory resource may be integrated in the same device as a processor resource or it may be separate but accessible to that device and the processor resource. A memory resource may be distributed across devices.

The controller 200 may be circuitry or a combination of circuitry and executable instructions. Such components may be implemented in a number of fashions. Looking at FIG. 12, the executable instructions may be processor-executable instructions, such as program instructions, stored on the memory resource 220, which is a tangible, non-transitory computer-readable storage medium, and the circuitry may be electronic circuitry, such as processor resource 222, for executing those instructions. The instructions residing on a memory resource may comprise any set of instructions to be executed directly (such as machine code) or indirectly (such as a script) by a processor resource.

In some examples, the controller 200 may include the executable instructions that may be part of an installation package that when installed may be executed by a processor resource to perform operations of the controller 200, such as methods described with regards to FIGS. 13-17. In that example, a memory resource may be a portable medium such as a compact disc, a digital video disc, a flash drive, or memory maintained by a computer device, such as a print server, from which the installation package may be downloaded and installed. In another example, the executable instructions may be part of an application or applications already installed. A memory resource may be a non-volatile memory resource such as read only memory (ROM), a volatile memory resource such as random access memory (RAM), a storage device, or a combination thereof. Example forms of a memory resource include static RAM (SRAM), dynamic RAM (DRAM), electrically erasable programmable ROM (EEPROM), flash memory, or the like. A memory resource may include integrated memory such as a hard drive (HD), a solid state drive (SSD), or an optical drive.

Figure 13:
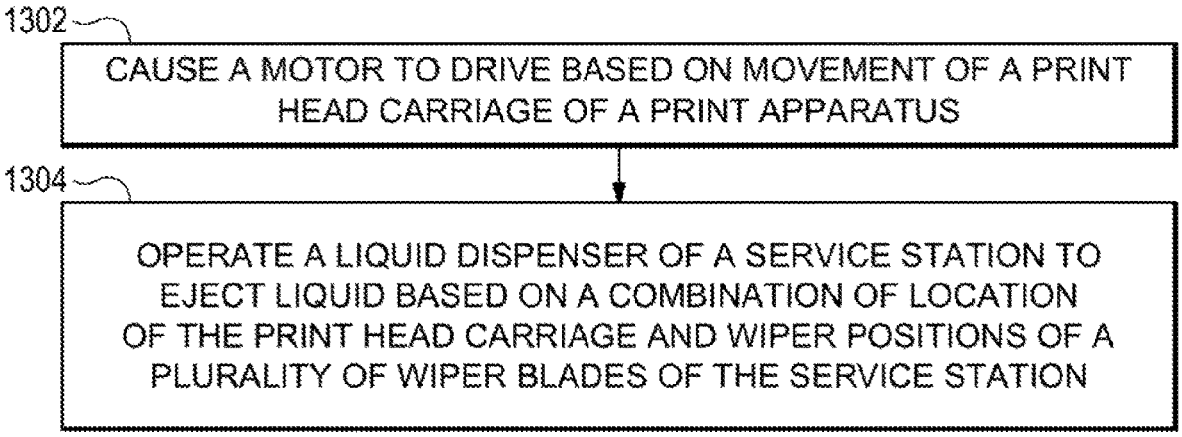
FIGS. 13-17 are flow diagrams depicting example methods of operation of wiper blades.

FIGS. 13-17 are flow diagrams depicting example methods of coordinating operation of a liquid dispenser of a wiper system. Referring to FIG. 13, example methods of liquid spray coordination generally include causing a motor to drive and operating a liquid dispenser of a service station. A controller of the service station, such as controller 200, may execute instructions to, cause the print apparatus to perform the methods of FIGS. 13-17.

At block 1302 of FIG. 13, a motor corresponding to the wiper blades is caused to be driven based on movement of a print head carriage of print apparatus. For example, the motor may adjust a cam to move wiper blades to positions based on the location and/or direction of movement of the print head carriage.

At block 1304 of FIG. 13, a liquid dispenser of a service station to eject liquid based on a combination of location of the print head carriage and wiper positions of a plurality of wiper blades of the service station. For example, the liquid dispenser may eject liquid when a first wiper blade is at rest, a second wiper blade is extended, and the print head carriage is outside of the service zone.

Figure 14:
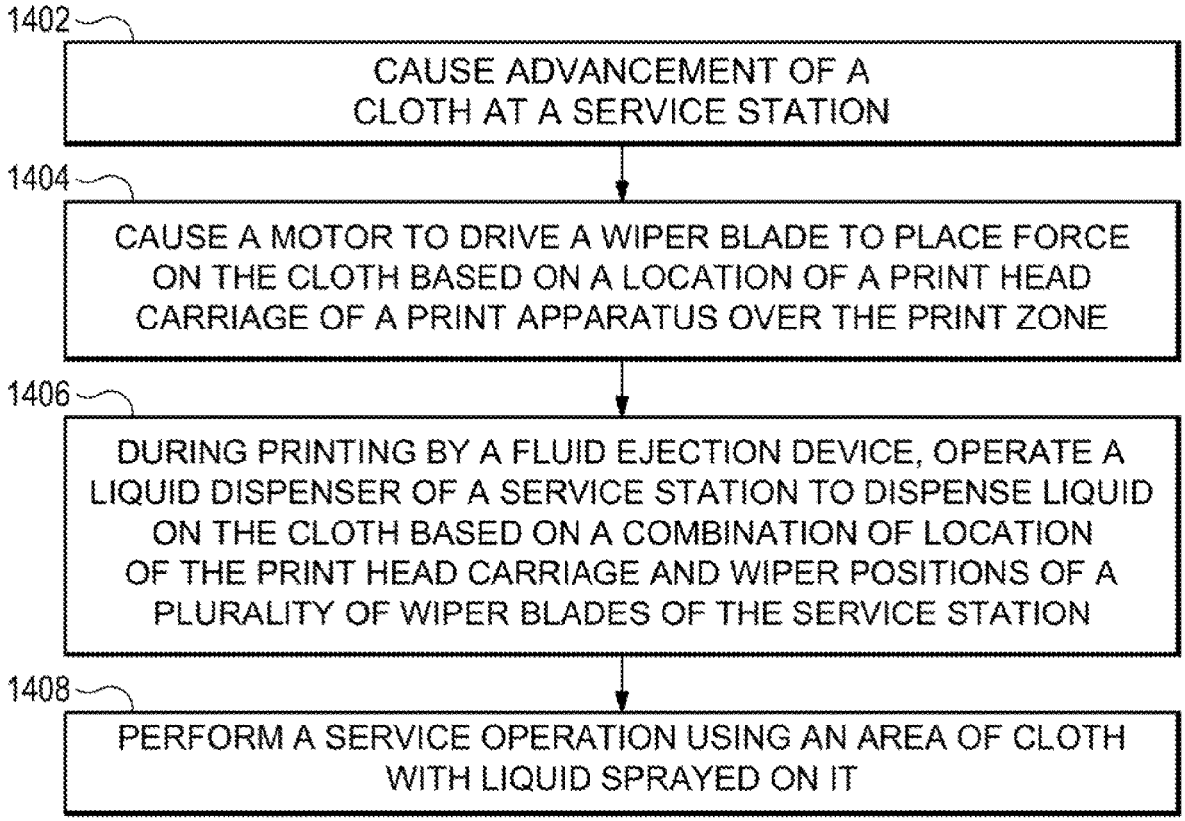

FIG. 14 includes blocks similar to blocks of FIG. 13 and provides additional blocks and details. In particular, FIG. 14 depicts additional blocks and details generally regarding cloth advancement and performing a service operation. Blocks 1404 and 1406 are the same as blocks 1302 and 1304 of FIG. 13 and, for brevity, their respective descriptions are not repeated in their entirety.

At block 1402, a cloth of the service station is advanced. For example, an unused portion of cloth is moved by a cloth advancement mechanism, such as cloth advancement mechanism 114, over a wiper blade before a service operation is performed on a print head. The wiping cloth may be advanced before the first wiper blade moves into the service position (e.g., at the beginning of a set of service operations) and may be performed during a printing operation by a fluid ejection device. The liquid dispenser may deposit liquid on the cloth during a printing operation by the fluid ejection system at block 1406. With the cloth placed and prepped before the servicing operation, a service operation is ready to be performed using the area of cloth with liquid sprayed on it before, after, or in between printing operations, at block 1408, for example.

Figure 15:
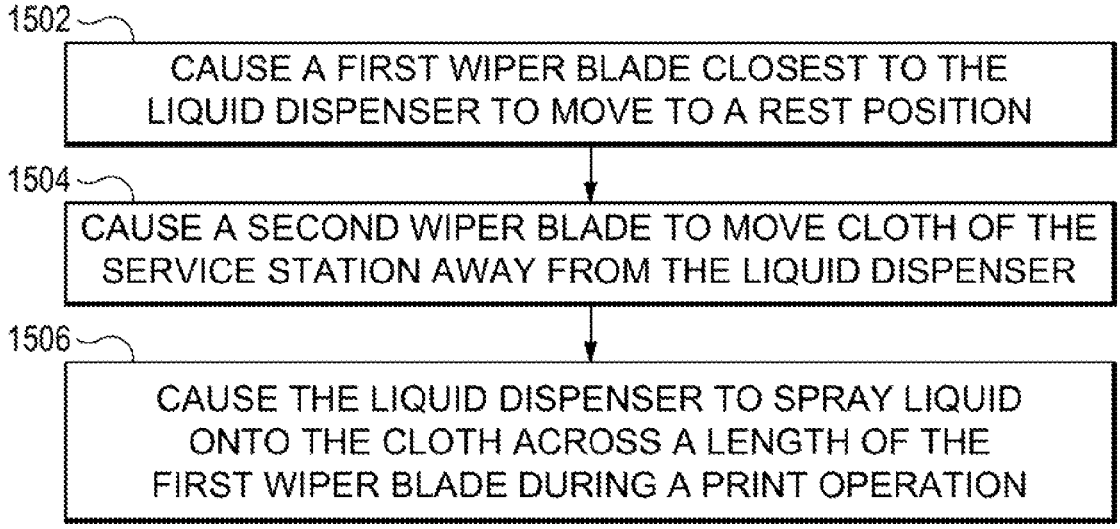

Referring to FIG. 15, example methods of coordination of operation of a liquid dispenser to eject liquid may be based on wiper attributes. A first wiper blade that is closest to the liquid dispenser is caused to move to a rest position at block 1502, a second wiper blade is caused to move cloth of the service station away from the liquid dispenser at block 1504, and the liquid dispenser is activated to spray liquid onto the cloth across a length of the first wiper blade during a print operation at block 1506. For example, the first wiper blade moves to a rest position to avoid hindering the ejection of the liquid from a liquid dispenser, the second wiper blade moves to a service position to lift the cloth and ensure the cloth is at a position to receive a distributed spray pattern across the length of the wiper blade (e.g., across the width of the cloth) to cover substantially the whole cloth with a center of the spray near the center of the width of the cloth (where the spray may be deposited over a wiper blade calibrated to produce the most force on the cloth).

Example methods of coordination of operation of a liquid dispenser to eject liquid may generally comprise coordination among components of a print apparatus such as coordinating operations of a service station with operations of a print head carriage. Example methods of coordination by a print apparatus of spray from a liquid dispenser of a service station may generally include causing a cloth advancement, operating a cam to position a plurality of blades, causing the liquid dispenser to spray cloth with cleaning liquid, causing a blade to move to a service position, and driving a print head carriage to cause a wiping operation. Block 1602 is similar to block 1402 of FIG. 14 and, for brevity, the corresponding description is not repeated.

At block 1604, a cam is operated to position a plurality of blades. For example, a controller may operate a motor to rotate a cam to place the plurality of blades into a state where one of the blades is in a rest position and another blade is in a service position. In that example, the blade in the service position may lift the cloth to be sprayed with liquid by a liquid dispenser. For example, at block 1606, a liquid dispenser is activated to spray cloth with cleaning liquid while the one of the blades in the rest position and another blade is in the service position. For another example, a liquid dispenser may spray the cloth with cleaning liquid over an area corresponding to one of the blades in the rest position calibrated to produce more force on the cloth than another blade (e.g., the blade to be sprayed over is calibrated to be in the highest service position or otherwise provide the most force on the cloth). In that example, the area of the cloth to receive the cleaning liquid is positioned across (e.g., above) from the blade in the rest position calibrated to produce more force than another blade.

At block 1608, the blade in the rest position is moved to a service position. In this manner, the blades are switched positions from a rest position to a service position or vice versa depending on the servicing operation to be performed. For example, a first wiper blade is moved to a rest position at block 1604 to allow for an area of the cloth above the first wiper blade to be sprayed with liquid and is then the first wiper blade is moved at block 1608 to place pressure on the cloth where the liquid was sprayed. At block 1610, a print head carriage is driven to cause a face of a print head to come in contact with the area of the cloth with the cleaning liquid deposited by the liquid dispenser at block 1606. In this manner, a service station may be operated (e.g., via execution of instructions by a controller) to coordinate positions of a plurality of wipers to add liquid to a cloth and coordinate positions of the plurality of wipers to use the wet area to perform a service operation. In other example systems, the service system may be driven to move the cloth against a fixed print head.

Figure 16:
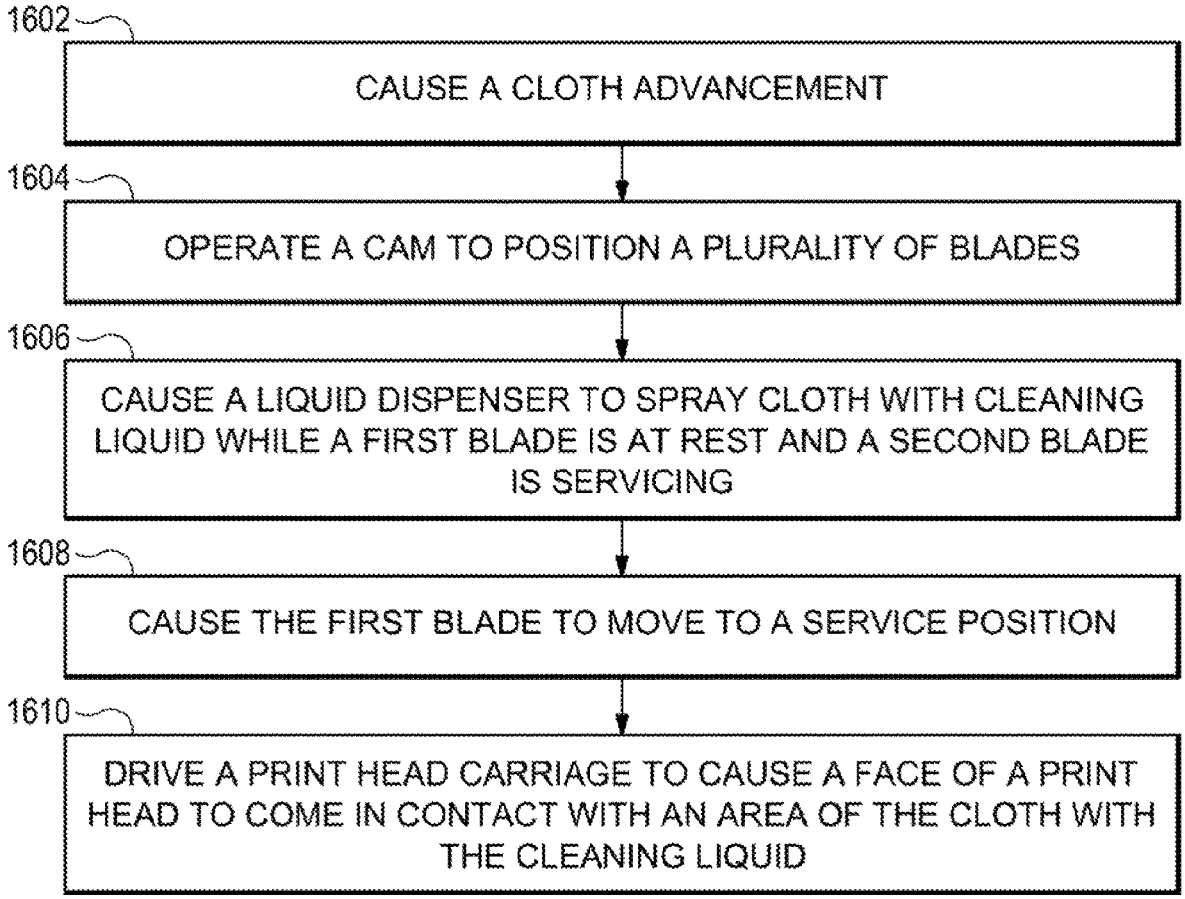
Figure 17:
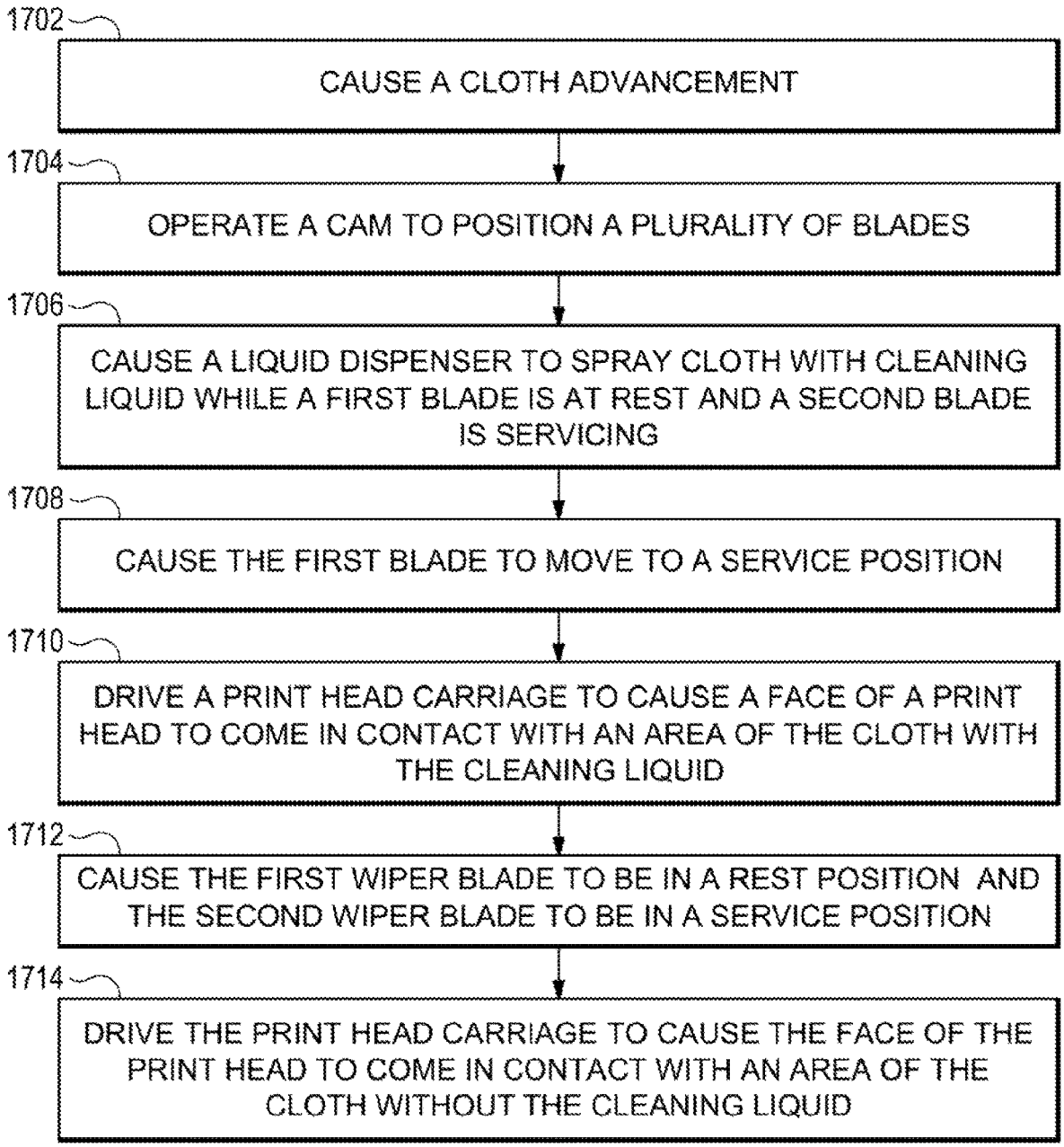

FIG. 17 includes blocks similar to blocks of FIG. 16 and provides additional blocks and details. In particular, FIG. 17 depicts additional blocks and details generally regarding switching positions of the wiper blades and driving the print head carriage to come in contact with different parts of the cloth. Blocks 1702-1710 are the same as blocks 1602-1610 of FIG. 16 and, for brevity, their respective descriptions are not repeated in their entirety.

At block 1712, the first wiper blade is moved to a rest position and the second wiper blade is moved to service position. For example, at blocks 1706-1710, the one of the blades to be sprayed over is moved to a rest position, sprayed over, moved to a service position, and then moved out of the way to a rest position while a second wiper blade is moved into a service position at block 1712 which may not place force on the same area of the first wiper blade. For example, the second wiper blade may be placed in a service position at block 1712 at an area of the cloth without cleaning liquid from the liquid dispenser (where the first wiper blade was placed in a service position at the area of the cloth with cleaning fluid at block 1708). At block 1714, a print head carriage is driven to cause the second service operation. For example, the print head carriage may be driven by a controller to cause the face of the print head to come in contact with the area of the cloth without the cleaning liquid deposited by the liquid dispenser at block 1706.

In this manner, the wiper blades of the service station may be toggled in a variety of combination of servicing positions and rest positions to perform different types of servicing operations (e.g., one wiper blade performs a service operation with wet area of the cloth and another wiper blade performs another service operation with an area of the cloth drier than the wet area of the cloth). The example methods described herein, including the example method of FIG. 17, demonstrates that operation of a liquid dispenser may include coordinating multiple types of service operations with movement of the print head carriage and position of blades of a wiper system.

Although the flow diagrams of FIGS. 13-17 illustrate specific orders of execution, the order of execution may differ from that which is illustrated. For example, the order of execution of the blocks may be scrambled relative to the order shown. Also, the blocks shown in succession may be executed concurrently or with partial concurrence. All such variations are within the scope of the present description.

All of the features disclosed in this specification (including any accompanying claims, abstract and drawings), and/or all of the elements of any method or process so disclosed, may be combined in any combination, except combinations where at least some of such features and/or elements are mutually exclusive.

The present description has been shown and described, with reference to the foregoing examples. It is understood, however, that other forms, details, and examples may be made without departing from the spirit and scope of the following claims. The use of the words "first," "second," or related terms in the claims are not used to limit the claim elements to an order or location, but are merely used to distinguish separate claim elements.

What is claimed is:

1. A wiper system comprising:

a first wiper blade;

a second wiper blade oriented parallel to the first wiper blade; and a liquid dispenser oriented to eject liquid towards a cloth area across from the first wiper blade when the first wiper blade is in a rest position and the second wiper blade is in a service position.

2. The system of claim 1, comprising:

the liquid dispenser is mounted to a frame in a fixed position oriented to emit a spray pattern that extends across a length of the first wiper blade.

3. The system of claim 1, wherein:

a cam coupled to the first wiper blade to move the first wiper blade to a service position when the cam is in a first cam position and coupled to the second wiper blade to move the second wiper blade to the service position when the cam is in the second cam position, the second wiper blade to assist the liquid dispenser in distributing liquid on the cloth area when the second wiper blade is in the service position.

4. The system of claim 3, comprising:

a controller coupled to the liquid dispenser to coordinate liquid ejection with position of the first wiper blade, the controller to cause the liquid dispenser to eject liquid when the cam is rotated to an angle corresponding to the second cam position and a print head carriage of a print apparatus is in a print zone of the print apparatus.

5. The system of claim 4, wherein:

the first wiper position and the second wiper position are at different heights with respect to a rest position of the cloth; and the second wiper blade is to be in a position higher than the first wiper blade during liquid ejection.

6. The system of claim 1, comprising:

a motor encoded with a gear system between a shaft and the motor; and a controller to:

drive the motor to move the first wiper blade to a rest position before ejection of liquid; and cause the liquid dispenser to eject a spray pattern on the cloth before a print head is serviced by the cloth during a pass of the print head carriage over a service zone of the print apparatus.

7. The system of claim 6, comprising:

a cam coupled to the shaft, the controller to operate the motor to rotate the cam via the gear system based on an angle to lift the first wiper blade or the second wiper blade to a selected height.

8. The system of claim 7, comprising:

a first pair of plates on each end, of the shaft corresponding to the first wiper blade; and a second pair of plates on each end of the shaft corresponding to the second wiper blade, wherein:

the cloth is impregnated with a cleaning fluid; and the liquid dispenser is to eject liquid over a wiper blade calibrated to place the most force on the cloth.

9. A non-transitory computer-readable storage medium comprising a set of instructions executable by a processor resource to:

cause a motor to drive based on movement of a print head carriage of a print apparatus; and operate a liquid dispenser of a service station to eject liquid based on a combination of location of the print head carriage and wiper positions of a plurality of wiper blades of the service station.

10. The medium of claim 9, wherein the set of instructions is executable by the processor resource to:

cause advancement of a cloth of the service station;

cause the liquid dispenser to deposit liquid on the cloth before the print head carriage exits a print zone.

11. The medium of claim 10, wherein the set of instructions is executable by the processor resource to:

cause a first wiper blade of the plurality of wiper blades closest to the liquid dispenser to move to a rest position;

cause a second wiper blade of the plurality of wiper blades to move cloth of the service station away from the liquid dispenser; and cause the liquid dispenser to spray liquid onto the cloth across a length of the first wiper blade during a print operation.

12. The medium of claim 11, wherein the plurality of wiper blades are calibrated to produce various forces on the cloth and the set of instructions is executable by the processor resource to:

cause the liquid dispenser to spray liquid on a cloth area positioned over a wiper blade of the plurality of wiper blades calibrated to produce the most force on the cloth.

13. A method of liquid spray coordination comprising:

causing a cloth advancement mechanism to advance cloth of a service station;

operating a cam to position a plurality of blades into a state where one of the blades is in a rest position and another blade is in a service position;

causing a liquid dispenser to spray cloth with cleaning liquid while the one of the blades is in the rest position and the another blade is in the service position;

causing the one of the blades to move to a service position at an area of the cloth with the cleaning liquid; and driving a print head carriage to cause a face of a print head coupled to the print head carriage to come into contact with the area of the cloth with the cleaning liquid.

14. The method of claim 13, comprising:

causing the another blades to move to a service position at an area of the cloth without the cleaning liquid; and driving the print head carriage to cause the face of a print head to came into contact with the area of the cloth without the cleaning liquid.

15. The method of claim 14, wherein:

the one of the blades in the rest position is at the time the liquid dispenser sprays the cloth with cleaning liquid is calibrated to produce more force on the cloth than the another blade; and the area of the cloth to receive the cleaning liquid is positioned across from the one of the blades.

* * * * *